US006705951B2

(12) United States Patent
Beauregard

(10) Patent No.: US 6,705,951 B2
(45) Date of Patent: Mar. 16, 2004

(54) GRIP MENTOR

(76) Inventor: Charles Beauregard, 2425 Warwick Cir., Conway, SC (US) 29526

( * ) Notice: Subject to any disclaimer, the term of this patent is extended or adjusted under 35 U.S.C. 154(b) by 0 days.

(21) Appl. No.: 10/164,402

(22) Filed: Jun. 10, 2002

(65) Prior Publication Data

US 2002/0151373 A1 Oct. 17, 2002

Related U.S. Application Data

(63) Continuation-in-part of application No. 09/662,763, filed on Sep. 15, 2000, now abandoned.

(51) Int. Cl.[7] ..... A63B 53/14
(52) U.S. Cl. ..... 473/206
(58) Field of Search ..... 473/206, 201, 473/203, 204, 219, 226, 300

(56) References Cited

U.S. PATENT DOCUMENTS

| | | | | | |
|---|---|---|---|---|---|
| 1,648,354 | A | * | 11/1927 | Lied | 75/395 |
| 1,997,364 | A | * | 4/1935 | Holden et al. | 473/206 |
| 2,690,338 | A | * | 9/1954 | De Brocke | 473/203 |
| 2,710,190 | A | * | 6/1955 | Schimansky | 473/206 |
| 2,928,678 | A | * | 3/1960 | Cutting | 473/206 |
| 3,111,322 | A | | 11/1963 | English | |
| 3,806,130 | A | | 4/1974 | Jacques | |
| 3,868,110 | A | * | 2/1975 | Jones | 473/551 |
| 3,879,048 | A | * | 4/1975 | Penney | 280/821 |
| 4,006,896 | A | * | 2/1977 | Soldavini | 473/551 |
| 4,103,896 | A | | 8/1978 | Lorang | |
| 4,361,326 | A | * | 11/1982 | Kokes | 473/206 |
| 4,861,034 | A | | 8/1989 | Lee | |
| 4,934,024 | A | * | 6/1990 | Sexton, I | 16/421 |
| 5,167,416 | A | * | 12/1992 | Painter | 473/204 |
| 5,295,688 | A | | 3/1994 | Montgomery | |
| 5,299,802 | A | * | 4/1994 | Bouchet-Lassale | 473/206 |
| 5,348,303 | A | * | 9/1994 | Swissheim | 473/201 |
| 5,398,930 | A | * | 3/1995 | Gibson | 473/201 |
| 5,403,008 | A | * | 4/1995 | Mainiero | 473/201 |
| 5,595,544 | A | * | 1/1997 | Roelke | 473/203 |
| 5,611,533 | A | * | 3/1997 | Williams | 473/568 |
| 5,729,864 | A | * | 3/1998 | Lie et al. | 16/421 |
| 5,762,563 | A | | 6/1998 | Holzhausen | |
| 5,851,156 | A | | 12/1998 | Schwark, Jr. | |
| 5,954,591 | A | * | 9/1999 | Liberatore | 473/206 |
| 5,984,795 | A | * | 11/1999 | Stafford | 473/206 |
| 5,997,408 | A | | 12/1999 | Bankhead | |
| 6,022,278 | A | * | 2/2000 | Vela | 473/201 |

FOREIGN PATENT DOCUMENTS

| | | |
|---|---|---|
| GB | 174490 | 2/1922 |
| WO | 93/12844 | 7/1993 |

* cited by examiner

*Primary Examiner*—Sebastiano Passaniti
*Assistant Examiner*—Nini F. Legesse
(74) *Attorney, Agent, or Firm*—Richard C. Litman

(57) ABSTRACT

A golf training aid for improving key elements of a golfer's grip and swing including a friction-fitting, tubular body having a truncated pyramidal shaped distal end and an adjacent oval opening. The aid is adapted to fit on the grip portion of a golf club.

6 Claims, 2 Drawing Sheets

GRIP MENTOR

CROSS-REFERENCE TO RELATED APPLICATIONS

This application is a continuation-in-part of application Ser. No. 09/662,763 filed Sep. 15, 2000 now abandoned.

BACKGROUND OF THE INVENTION

1. Field of the Invention

The present invention relates generally to golf training aids. More specifically, the invention is a golf grip training device having a quasi-tubular body which friction-fits the grip of a golf club.

2. Description of the Related Art

The related art of interest describes various golf training devices, but none discloses the present invention. There is a need for an economical, simplified and unencumbered golf grip and swing training device. The related art will be discussed in the order of perceived relevance to the present invention.

U.S. Pat. No. 3,806,130 issued on Apr. 23, 1974, to Edward J. Jacques describes a golf club grip training aid comprising a tapered split sleeve for a golf club handle having a notch to receive the thumb of the rearward hand. The purpose of the device is to prevent the forward hand from gripping the club too tightly. The device is distinguishable for its retention on the grip of the golf club.

W.I.P.O. Document No. WO 93/12844 published on Jul. 8, 1993, for Matthew J. Bencriscutto describes a golf club grip training aid comprising a band of flexible material having an aperture for receiving the thumb of a first hand and an adjustable loop adjacent to the aperture that receives the thumb of the second hand. The training aid is reversible by moving the loop through a slot in the band that adjoins the loop. The training aid device is distinguishable for its limitation to the thumbs.

Great Britain Patent Application No. 174,490 published on Feb. 2, 1922, for John R. Walker describes a security hand grip attachment on a golf club or other stick handles comprising a split collar having a hooked finger grip formed at a slight angle to fit against the fourth finger of the hand. The device is distinguishable for its attachment to a golf club handle.

U.S. Pat. No. 5,299,802 issued on Apr. 5, 1994, to Jean Bouchet-Lassale describes a removable golf club grip provided with hollows and protuberances enabling the golfer to automatically adopt a correct position of the hands on the grip portion. The grip device is distinguishable for its limitation to attachment directly over an existing golf club handle.

U.S. Pat. No. 3,111,322 issued on Nov. 19, 1963, to Orville J. Schwark, Jr. describes a golf club grip training device comprising a golf grip permanently installed having individual finger placement tabs on springs. The device is distinguishable for its required finger placement tabs on springs.

U.S. Pat. No. 5,851,156 issued on Dec. 22, 1998, to Orville J. Schwark, Jr. describes a golf swing training device removably attached to the grip having a planar and apertured rectangular frame. The device is distinguishable for its frame structure.

U.S. Pat. No. 4,103,896 issued on Aug. 1, 1978, to Walter R. Lorang describes a golf grip training apparatus comprising a mechanism attached by fasteners to the forward part of the grip. The device emits a signal when the grip of the off-target hand interferes with the grip of the target hand in the swing of the club. The signaling device is distinguishable for its mechanism and permanent attachment to a golf club handle.

U.S. Pat. No. 4,861,034 issued on Aug. 29, 1989, to Sung Y. Lee describes a golf-grip training device comprising an elongated pressure sensitive switch mounted on the underside of the handle and responsive to the grip pressure of the golfer. The switch is formed of three resilient conducting strips adhesively secured to a number of spaced compressible foam blocks forming two sandwich layers. A signaling device contains a battery, a buzzer and a grip pressure selector switch and mounted on the shaft. The device is distinguishable for its electronic system integrated with the handle.

U.S. Pat. No. 5,295,688 issued on Mar. 22, 1994, to Robert Montgomery describes a thumb alignment grip guide device comprising a thumb barrier hingedly secured to a clamp band fastened to the golf club handle. The device is distinguishable for being limited to the thumb of the forward hand and its attachment to the handle.

U.S. Pat. No. 5,762,563 issued on Jun. 9, 1998, to Mark Holzhausen describes a golf handgrip guide device comprising a T-shaped guide with protruding adjustable pegs for attachment by an elastic band to the grip. The device is distinguishable for its structure requiring pegs.

U.S. Pat. No. 5,997,408 issued on Dec. 7, 1999, to Sam D. Bankhead describes a training aid for chipping and putting comprising a shaped elongate shaft with one end coupled to the club shaft below the grip and the opposite end adapted for positioning through an armpit. The device is distinguishable for its structure.

None of the above inventions and patents, taken either singularly or in combination, is seen to describe the instant invention as claimed. Thus, a golf training aid solving the aforementioned problems of complexity and attachment is desired.

SUMMARY OF THE INVENTION

The present invention dubbed the "Grip Mentor" is directed to a golf training device having a tubular body open at its rear and having a truncated pyramidal shaped distal end. The device friction-fits the grip portion of a golf club and is provided with markings to ensure proper alignment when installing the device on the club. Use of the grip monitor will allow a golfer to attain a consistent grip and proper grip pressure. A correct grip will produce a repeatable swing and increased club head speed. A correct grip will function to prevent slicing or hooking, pinching and casting, re-gripping and early release.

Accordingly, it is a principal object of the invention to provide a removable golf grip training device which friction-fits the grip portion of a club.

It is another object of the invention to provide a golf grip training device having a tubular elastic body.

It is a further object of the invention to provide a golf grip training device having a tubular elastic body with a truncated pyramidal distal end and an adjacent oval cutout.

Still another object of the invention is to provide a golf grip training device having markings thereon to ensure proper alignment on a golf club.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
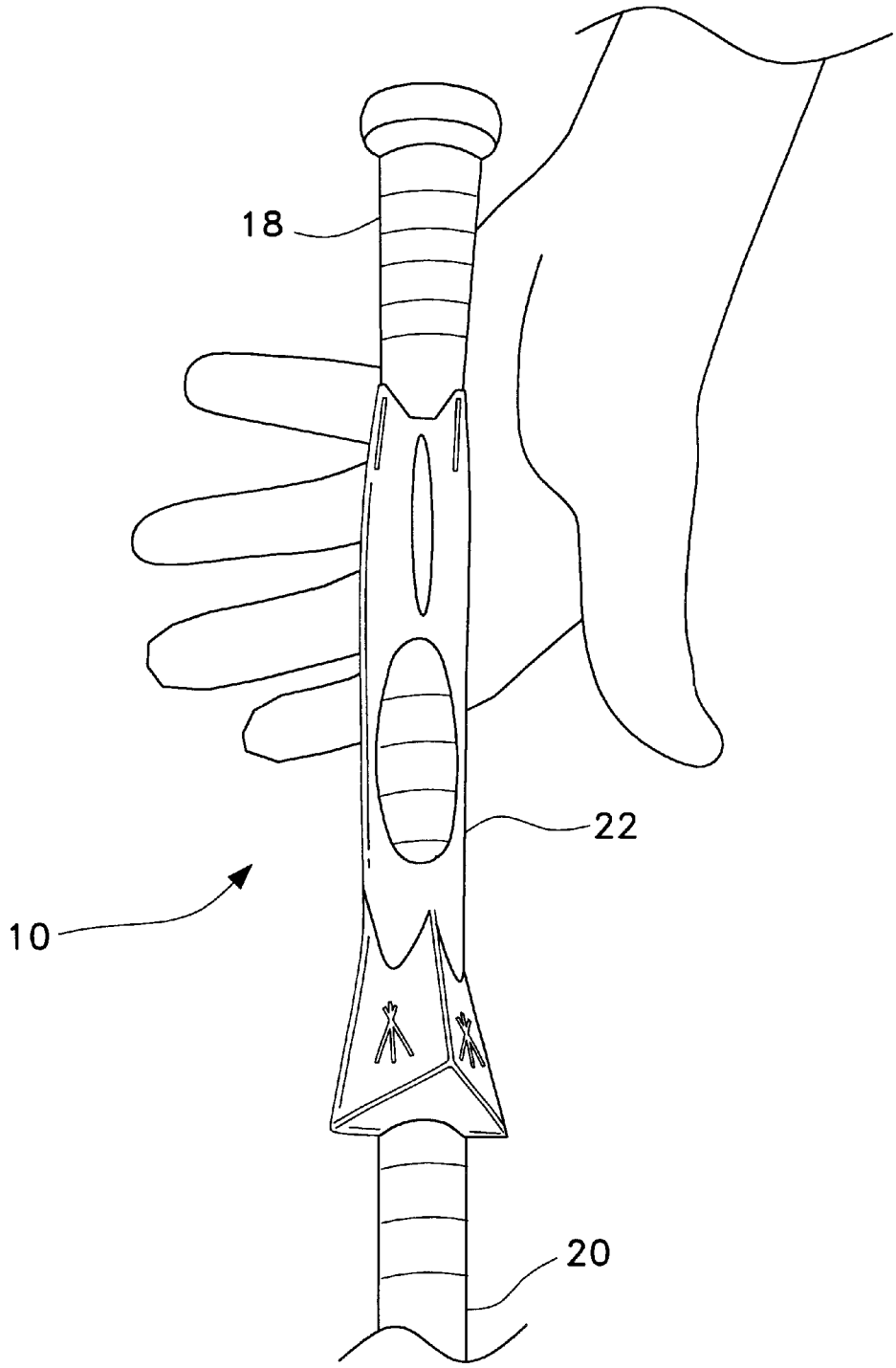
FIG. 1 is an environmental, perspective view of the grip training aid device on a golf club according to the present invention.
Figure 2:
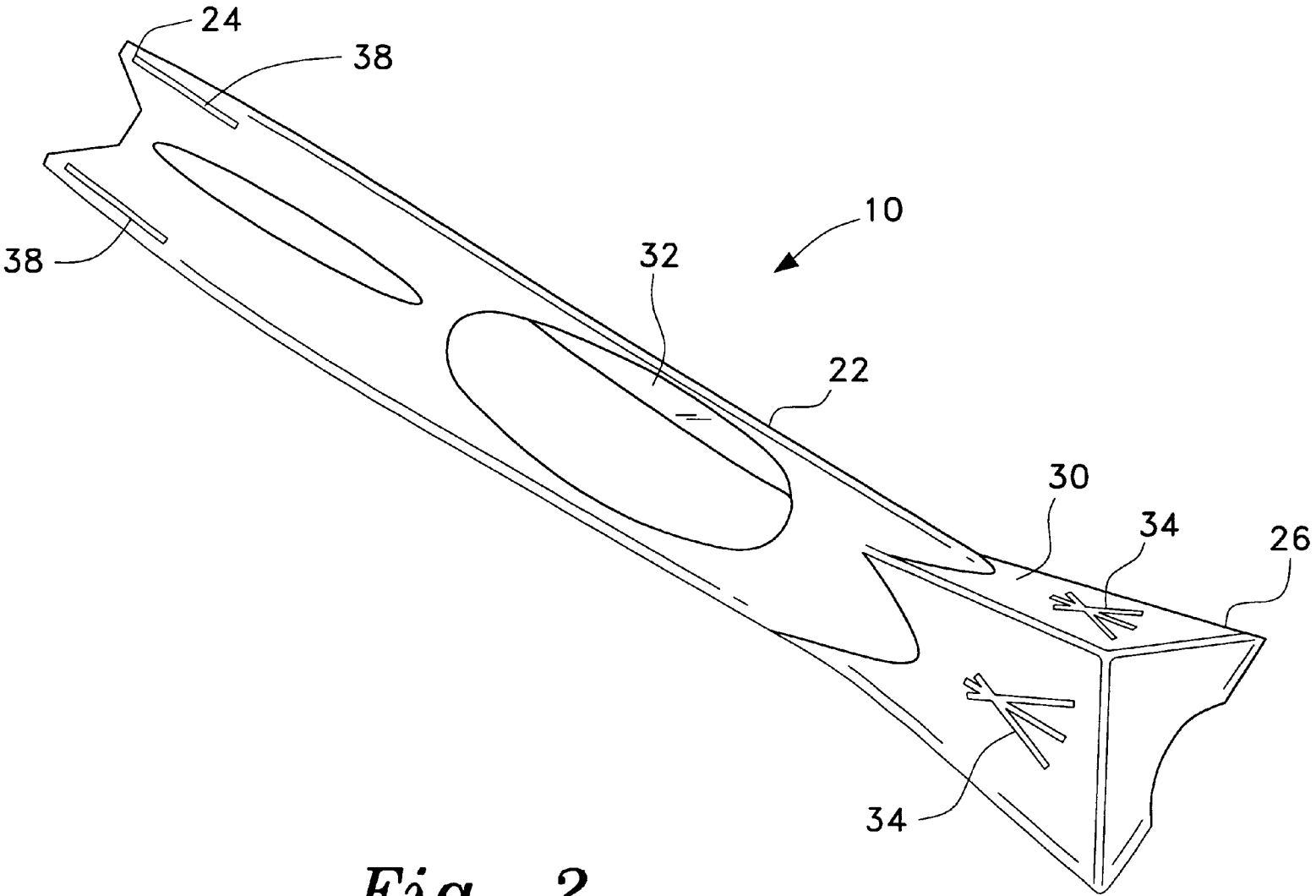
FIG. 2 is a perspective view of the grip training device according to the present invention.

The present invention is directed to a golf training aid device 10 illustrated in FIGS. 1 and 2 which is adapted to be used by a golfer to instill the proper grip on the grip portion 18 of the golf club 20. The golf training aid device 10 comprises a thin, flexible, tubular, plastic body 22 having a proximate end 24 and a distal end 26. The body 22 has a uniform radius of curvature and is opened at its rear. The preferred material for forming the body 22 is plastic, specifically polypropylene, because it enhances the friction fitting of the body 22 to any golf club grip portion. The distal end 26 has a truncated pyramidal configuration 30 and an oval aperture 32 positioned centrally and adjacent to the shaped distal end 26. In use, aperture 32 will receive the thumb of the upper gripping hand of the user. The truncated pyramidal will form a trigger with the index finger of the lower gripping hand (not shown). Markings 34 and 38 are respectively positioned on the faces of the truncated pyramid and at the proximate end of body 22. Markings 34, 38 will allow a user to ensure that the body is properly aligned on the club as will be explained below.

To install on a golf club, the user should hold the device of the instant invention at the base of the truncated pyramidal portion. Staring from the bottom of the grip, the device is slid upwards until the proximate end is approximately two to two and one-half inches from the top of the club's grip. It is essential that the alignment markings are aligned with the center of the grip. The final alignment can be visually confirmed in that when properly installed, the edge of the truncated pyramid will be at a two o'clock position relative to the face of the club. The edge should be at a ten o'clock position for left handed players.

After a period of use, securing a proper grip will become second nature and the device will not be needed. The device 10 can be used by any gender and by right- or left-handed golfers. This provides a real economic advantage in manufacturing the invention.

An exemplary size of the device 10 can be 6.5 in. in length and 1/32 to 1/16 in. thick. The oval aperture or ellipse 32 can be 1 and 1/4 in. in length and 5/8 in. wide. The composition of the device 10 must be polypropylene because leather has been found to be inadequate on a rubber grip portion 18.

It is to be understood that the present invention is not limited to the embodiment described above, but encompasses any and all embodiments within the scope of the following claims.

I claim:

1. A golf training aid adapted to be positioned on a grip portion of a golf club, said aid including:

a thin, flexible, tubular body having a front face, an open back, a proximate end and a distal end;

said distal end terminating in the shape of a truncated pyramid, said truncated pyramid having two faces; and an oval aperture positioned through said front face and positioned adjacent to said truncated pyramid at said distal end.

2. A golf training aid device according to claim 1, including alignment markings disposed on said proximate end and said distal end.

3. A golf training aid according to claim 2, wherein said markings disposed on said distal end are disposed on said two faces of said truncated pyramid.

4. A golf training aid according to claim 3, wherein said tubular body is fabricated from plastic material.

5. A golf training aid according to claim 4, wherein said plastic material is polypropylene.

6. A golf training aid according to claim 1, wherein said body has a longitudinal line of symmetry whereby the aid may be used by left or right handed golfers.

* * * * *